US006390204B1

(12) United States Patent
Schafle

(10) Patent No.: US 6,390,204 B1
(45) Date of Patent: May 21, 2002

(54) COMPACTION WHEEL FOR LANDFILL COMPACTORS

(75) Inventor: Alan T. Schafle, Richfield, OH (US)

(73) Assignee: Diamond Wheel & Fabricating, Inc., Cleveland, OH (US)

( * ) Notice: Subject to any disclaimer, the term of this patent is extended or adjusted under 35 U.S.C. 154(b) by 0 days.

(21) Appl. No.: 09/453,638

(22) Filed: Dec. 3, 1999

(51) Int. Cl.[7] ..... A01B 211/02
(52) U.S. Cl. ..... 172/554; 404/124
(58) Field of Search ..... 172/518, 540, 172/554–556, 539, 519, 538, 21; 404/124, 122; 111/194

(56) References Cited

U.S. PATENT DOCUMENTS

| | | | | | |
|---|---|---|---|---|---|
| 107,074 | A | * | 9/1870 | McConnughy | 172/554 |
| 459,640 | A | * | 9/1891 | Mauldin | 172/540 |
| 895,230 | A | * | 8/1908 | Beiier | 172/554 |
| 1,905,384 | A | * | 4/1933 | Jass | 172/554 |
| 2,235,953 | A | * | 3/1941 | Whitfield | 172/539 |
| 3,340,109 | A | | 9/1967 | Keough | |
| 3,450,013 | A | | 6/1969 | Peterson | |
| 3,463,063 | A | | 8/1969 | Caron et al. | |
| 3,559,545 | A | | 2/1971 | Caron | |
| 3,687,023 | A | | 8/1972 | Moser et al. | |
| 3,718,170 | A | | 2/1973 | Caron et al. | |
| 3,724,342 | A | | 4/1973 | Caron et al. | |
| 3,822,957 | A | | 7/1974 | Caron et al. | |
| 3,888,471 | A | | 6/1975 | Coch | |
| 3,922,106 | A | | 11/1975 | Caron et al. | |
| 4,066,375 | A | | 1/1978 | Caron et al. | |
| 4,090,570 | A | | 5/1978 | Alexander | |
| 4,523,873 | A | | 6/1985 | Elliot | |
| 4,530,620 | A | | 7/1985 | McCartney | |
| 4,693,023 | A | * | 9/1987 | Niemela | 172/539 |
| 4,750,792 | A | | 6/1988 | Caron et al. | |
| 4,858,697 | A | * | 8/1989 | Sherblom | 172/519 |
| 4,865,400 | A | | 9/1989 | Caron et al. | |
| 4,919,566 | A | | 4/1990 | Caron et al. | |
| RE33,312 | E | | 8/1990 | Elliot | |
| 4,991,662 | A | | 2/1991 | Caron et al. | |
| 5,330,260 | A | | 7/1994 | Freeman | |
| 5,366,568 | A | | 11/1994 | Bruce | |
| 5,421,670 | A | * | 6/1995 | Meirick | 404/124 |
| 5,451,100 | A | | 9/1995 | Freeman | |
| 5,511,901 | A | * | 4/1996 | Yates | 404/124 |
| 5,553,932 | A | | 9/1996 | Freeman | |
| 5,676,493 | A | | 10/1997 | Brockway | |
| 5,687,799 | A | | 11/1997 | Greenfield | |
| 5,713,644 | A | | 2/1998 | Freeman | |
| 5,795,097 | A | | 8/1998 | Caron et al. | |
| 5,820,230 | A | | 10/1998 | Freeman | |
| 5,951,123 | A | * | 9/1999 | Bomstad et al. | 305/107 |
| 6,095,717 | A | * | 8/2000 | Kaldenberg et al. | 404/124 |

* cited by examiner

*Primary Examiner*—Thomas B. Will
*Assistant Examiner*—Kristine Markovich
(74) *Attorney, Agent, or Firm*—Hahn Loeser & Parks, LLP

(57) ABSTRACT

A compaction wheel for landfill compactors which is fabricated as a two (2) piece assembly including a wheel core and a removable and replaceable outer sleeve. The outside surface of the removable and replaceable outer sleeve can be smooth or have cleats preassembled thereon. This is in contrast to known prior art compaction wheels for landfill compactors which are fabricated as an integral one (1) piece assembly. The compaction wheel for landfill compactors is fabricated as a two (2) piece assembly and allows a worn removable and replaceable outer sleeve to be quickly and easily removed in the field, if desired, and replaced with a new removable and replaceable outer sleeve without cutting into or removing material from the wheel core of the compaction wheel for landfill compactors. This is in contrast to known prior art compaction wheels for landfill compactors which generally require cutting into the wheel core when removing the worn outer portion which, in many cases, results in a reduction in the diameter of the compaction wheel for landfill compactors each time the outer portion of known prior art compaction wheels for landfill compactors is removed and replaced.

19 Claims, 8 Drawing Sheets

PRIOR ART

COMPACTION WHEEL FOR LANDFILL COMPACTORS

BACKGROUND AND SUMMARY OF THE INVENTION

The present invention relates generally to new and novel improvements in a compaction wheel for landfill compactors. More particularly, the present invention relates to a compaction wheel for landfill compactors which allows a worn removable and replaceable outer sleeve with or without cleats preassembled on an outer diameter thereof to be quickly and easily removed in the field, if desired, and replaced with a new removable and replaceable outer sleeve with or without cleats preassembled on an outer diameter thereof without cutting into or removing material from the wheel core of the compaction wheel for landfill compactors Steel compaction wheels are commonly used on landfill compactors. Such steel compaction wheels have typically be fabricated as an integral one (1) piece assembly including a wheel core and an outer portion which are joined together, typically by submerged arc welding, to form the steel compaction wheel as an integral one (1) piece assembly. Over time, the outer portions of such steel compaction wheels become worn through use and must be repaired and/or replaced. For example, repair and/or replacement of steel compaction wheels is typically necessary after approximately 20,000 hours of operation of landfill compactors.

In such steel compaction wheels fabricated as an integral one (1) piece assembly, it is necessary to either replace the entire steel compaction wheel when the outer portion is worn, which is relatively expensive, or cut into the wheel core to remove and replace the outer portion. Cutting into the wheel core results in removal of approximately one half (½) of the weight of the steel compaction wheel, approximately 2,500 pounds, and also weakens the structural integrity of the steel compaction wheel. In addition, repair of steel compaction wheels often results in a reduction in the diameter of the repaired steel compaction wheel and may result in an out of round condition and/or other dimensional discrepancies for the repaired steel compaction wheel. In addition, the weld in many repaired steel compaction wheels is not as strong as the original weld since a welding process, such as shielded metal arc welding (SMAW) or metal inert gas (MIG) welding, is used rather than a submerged arc welding (SAE) process as originally manufactured. In addition, repair welds often do not include a bevel in the sidewall, as when originally manufactured, thus making 100% weld penetration uncertain. Furthermore, as the original steel compaction wheel is cut apart, it may shift or move due to, for example, internal stresses. As the sidewalls shift or move, they may create smaller or larger gaps than desirable, thus resulting in inconsistent weld beads, and the running trueness of the steel compaction wheel may be negatively affected.

It is difficult to repair a steel compaction wheel fabricated as an integral one (1) piece assembly and maintain the original structural integrity and dimensional accuracy in a fabrication shop and almost impossible to accomplish in the field. Accordingly, it is most often necessary to remove and transport the steel compaction wheel to be repaired to a specialized fabrication shop to have the repair performed and then transport the repaired compaction wheel back to the field. This is not only expensive, but is also time consuming, and may result in the landfill compaction equipment and soil compaction equipment being out of service for several days or more if a replacement steel compaction wheel is not readily available.

Accordingly, an object of the present invention is the provision of a compaction wheel for landfill compactors which allows the worn outer portion of such compaction wheels to be easily and quickly repaired in the field.

Another object of the present invention is the provision of a compaction wheel for landfill compactors which is cost effective to fabricate, maintain and repair.

Yet another object of the present invention is the provision of a compaction wheel for landfill compactors which allows repair and/or replacement of the outer portion without a resultant reduction in the diameter of such compaction wheels or an out of round condition.

Still another object of the present invention is the provision of a compaction wheel for landfill compactors which is particularly suitable for use on landfill compactors in the field.

These and other objects of the present invention are attained by a compaction wheel for landfill compactors which is fabricated as a two (2) piece assembly including a wheel core and a removable and replaceable outer sleeve. The outside diameter of the removable and replaceable outer sleeve can be smooth or have cleats preassembled thereon. This is in contrast to known prior art compaction wheels for landfill compactors which are fabricated as an integral one (1) piece assembly. The compaction wheel for landfill compactors in accordance with the present invention fabricated as a two (2) piece assembly allows a worn removable and replaceable outer sleeve to be quickly and easily removed in the field, if desired, and replaced with a new removable and replaceable outer sleeve without cutting into or removing material from the wheel core of the compaction wheel for landfill compactors. This is in contrast to known prior art compaction wheels for landfill compactors which generally require cutting into the wheel core when removing a worn outer portion which, in many cases, results in a reduction in the diameter of the compaction wheel for landfill compactors each time the outer portion of known prior art compaction wheels for landfill compactors is removed and replaced.

Other advantages and novel features of the present invention will become apparent in the following detailed description of the invention when considered in conjunction with the accompanying drawings.

DETAILED DESCRIPTION OF THE DRAWINGS

Figure 1:
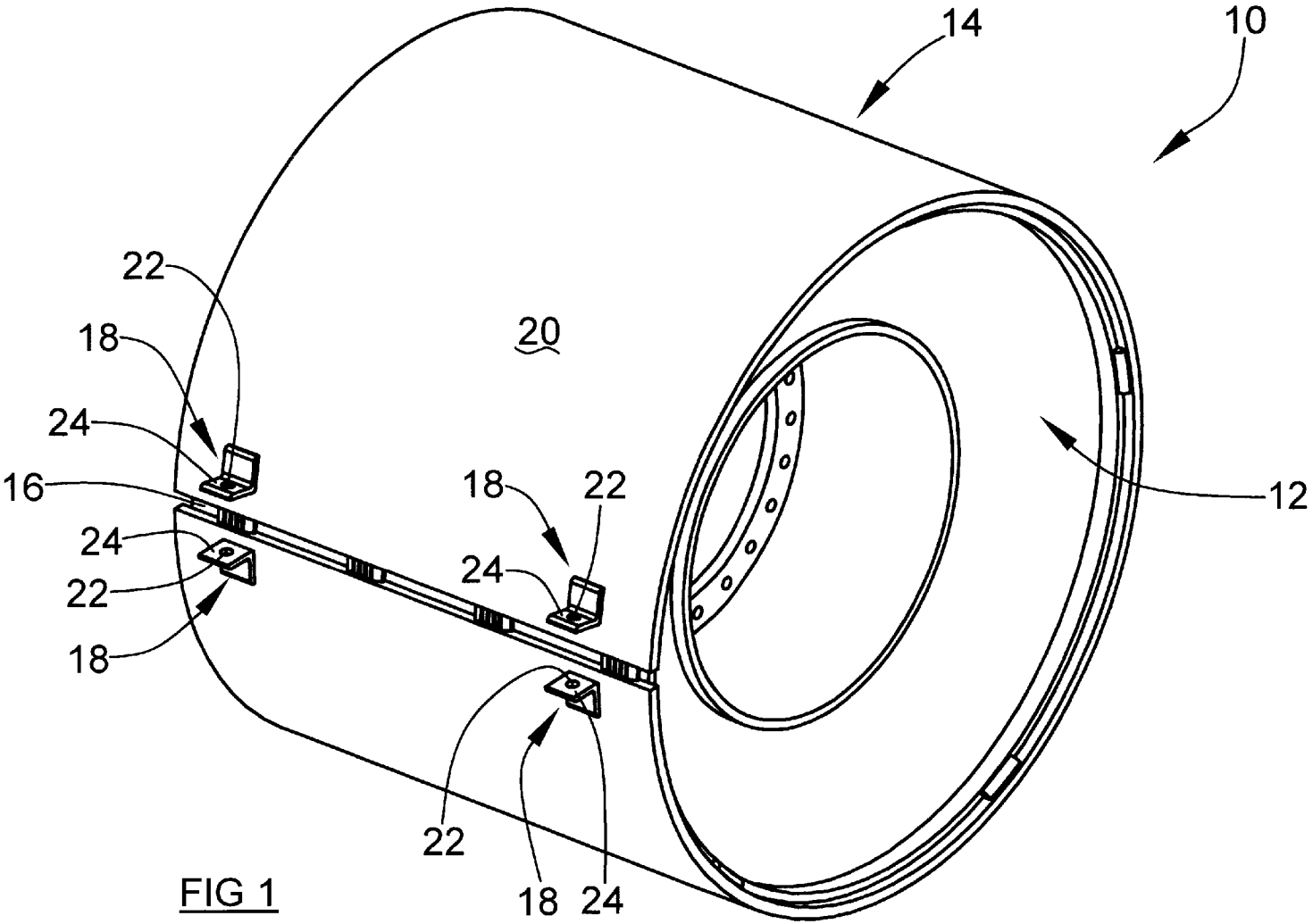
FIG. 1 is a prospective view of a compaction wheel for landfill compactors in accordance with a preferred embodiment of the present invention.

In the following detailed description of a preferred embodiment of the present invention, reference is made to the accompanying drawings which, in conjunction with this detailed description, illustrate and describe a preferred embodiment of a compaction wheel for landfill compactors in accordance with the present invention. Referring first to FIG. 1, which shows a prospective view of a compaction wheel for landfill compactors in accordance with a preferred embodiment of the present invention, compaction wheel for landfill compactors, generally identified by reference number 10, preferably includes wheel core 12 and outer sleeve 14.

Figure 2:
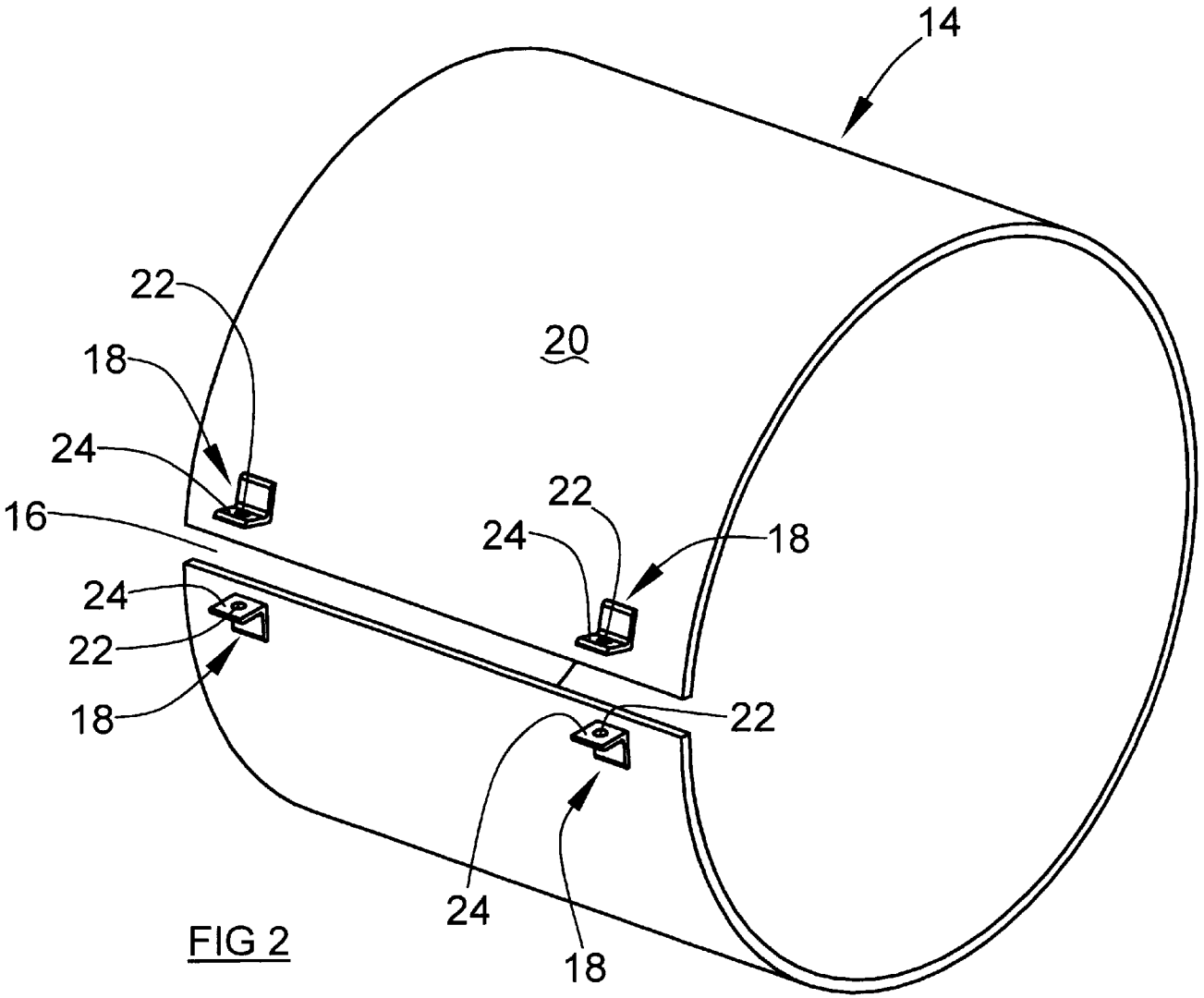
FIG. 2 is a prospective view of an outer sleeve used in the preferred embodiment of a compaction wheel for landfill compactors in accordance with the present invention shown in FIG. 1.

Referring to FIG. 2, which shows a prospective view of an outer sleeve used in the preferred embodiment of a compaction wheel for landfill compactors in accordance with the present invention shown in FIG. 1, outer sleeve 14 preferably includes seam 16 and four (4) brackets 18 affixed to exterior surface 20 of outer sleeve 14 adjacent to seam 16. Each bracket 18 preferably includes opening 22 in outwardly extending portion 24 of bracket 18.

Figure 3:
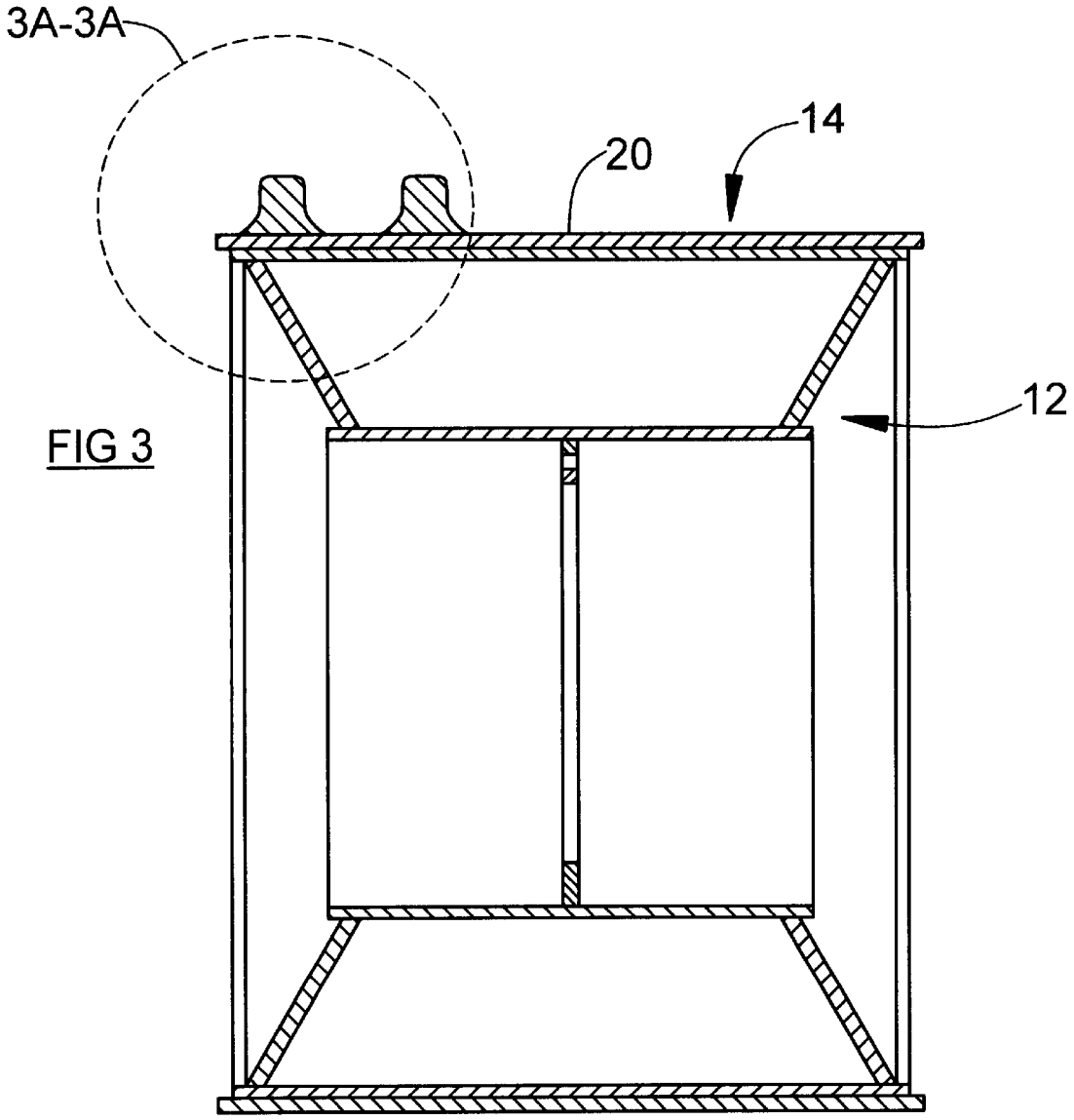
FIG. 3 is a longitudinal cross-sectional view of the preferred embodiment of a compaction wheel for landfill compactors in accordance with the present invention shown in FIG. 1 taken across line 3—3 in FIG. 1.
Figure 3A:
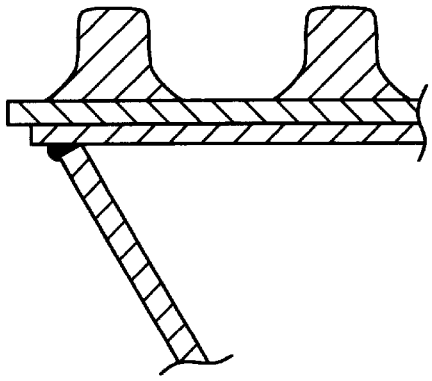
FIG. 3A is a detail longitudinal cross-sectional view of the preferred embodiment of a compaction wheel for landfill compactors in accordance with the present invention shown in FIG. 1 taken from circle 3A—3A in FIG. 3.
Figure 4:
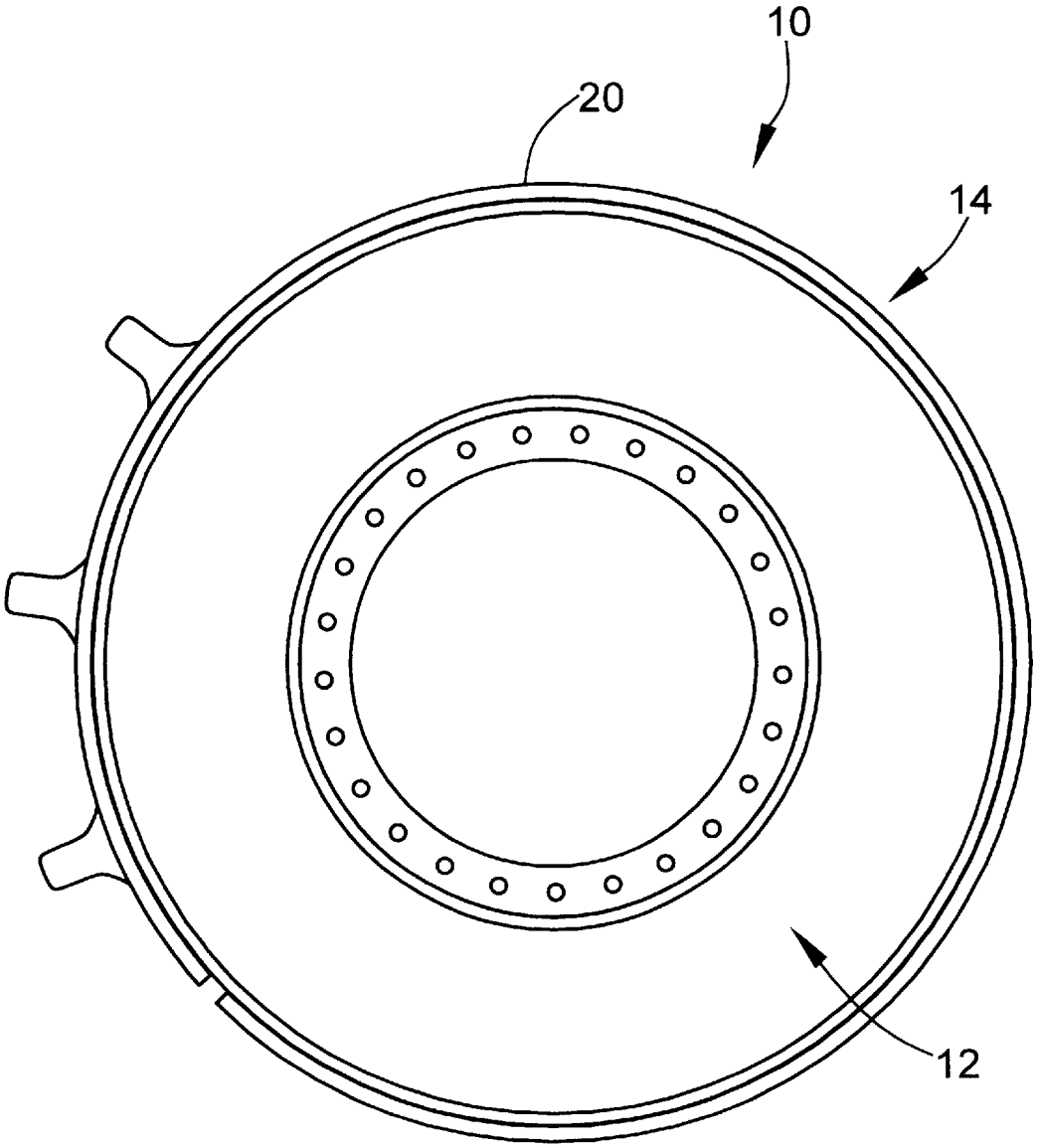
FIG. 4 is an end elevational view of the preferred embodiment of a compaction wheel for landfill compactors in accordance with the present invention shown in FIG. 1.

Referring to FIGS. 3, 3A and 4, which show a longitudinal cross-sectional view of the preferred embodiment of a compaction wheel for landfill compactors in accordance with the present invention shown in FIG. 1 taken across line 3—3 in FIG. 1, a detail longitudinal cross-sectional view of the preferred embodiment of a compaction wheel for landfill compactors in accordance with the present invention shown in FIG. 1 taken from circle 3A—3A in FIG. 3 and an end elevational view of the preferred embodiment of a compaction wheel for landfill compactors in accordance with the present invention shown in FIG. 1, respectively, outer sleeve 14 is positioned around the outside diameter of wheel core 12 to form compaction wheel for landfill compactors 10.

Figure 5:
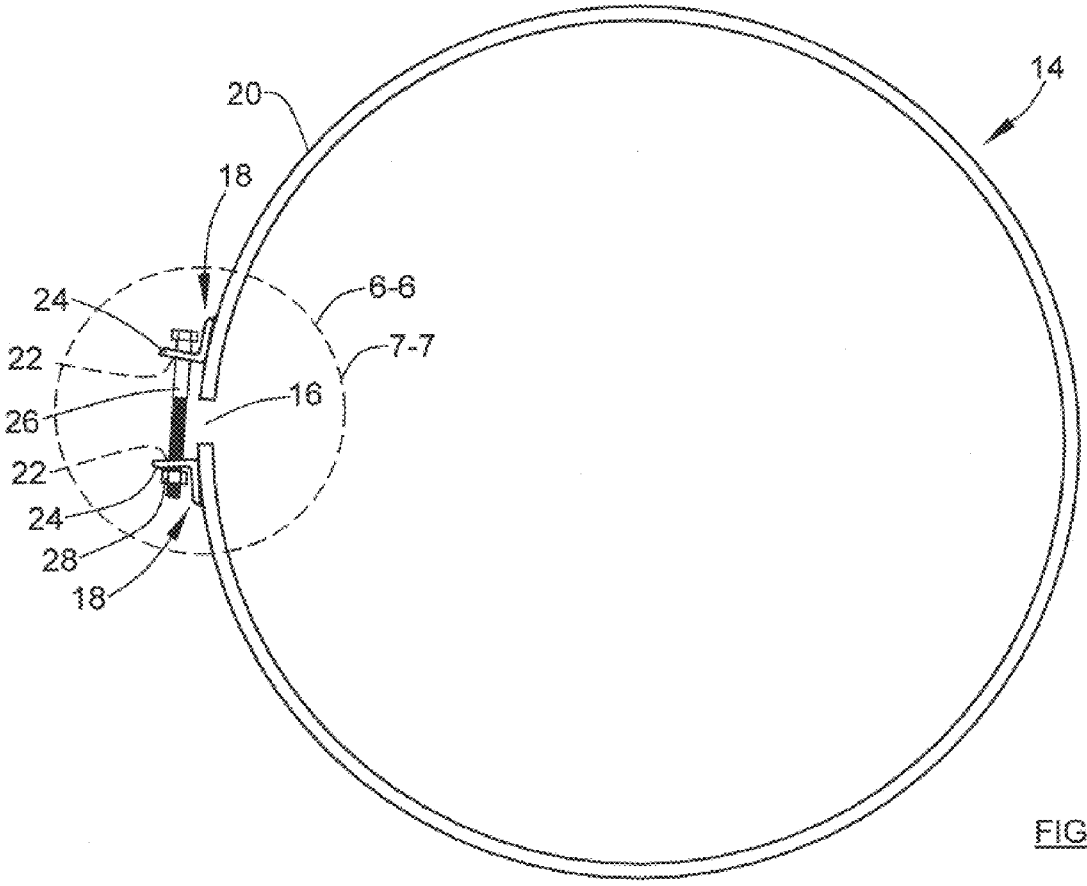
FIG. 5 is a side elevational view of the outer sleeve used in the preferred embodiment of a compaction wheel for landfill compactors in accordance with the present invention shown in FIG. 1.
Figure 6:
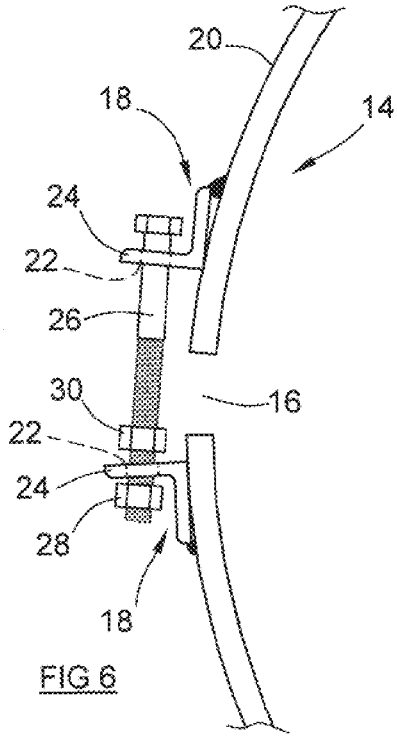
FIG. 6 is an exploded side elevational view of the outer sleeve in an open position used in the preferred embodiment of a compaction wheel for landfill compactors in accordance with the present invention shown in FIG. 1 taken from circle 6—6 in FIG. 5.
Figure 7:
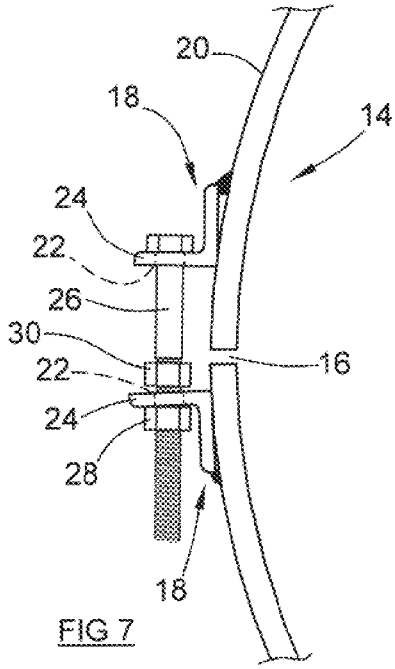
FIG. 7 is an exploded side elevational view of the outer sleeve in a closed position used in the preferred embodiment of a compaction wheel for landfill compactors in accordance with the present invention shown in FIG. 1 taken from circle 7—7 in FIG. 5.

Referring to FIGS. 5 through 7, which show a side elevational view of the outer sleeve used in the preferred embodiment of a compaction wheel for landfill compactors in accordance with the present invention shown in FIG. 1, an exploded side elevational view of the outer sleeve in an open position used in the preferred embodiment of a compaction wheel for landfill compactors in accordance with the present invention shown in FIG. 1 taken from circle 6—6 in FIG. 5 and an exploded side elevational view of the outer sleeve in a closed position used in the preferred embodiment of a compaction wheel for landfill compactors in accordance with the present invention shown in FIG. 1 taken from circle 7—7 in FIG. 5, respectively, seam 16 is preferably approximately three (3) inches wide when outer sleeve 14 is in its free state to allow outer sleeve 14 to slide over and around wheel core 12. Once outer sleeve 14 is slid over wheel core 12 and placed in the proper longitudinal position in relation to wheel core 12, threaded bolts 26 are inserted through openings 22 in corresponding brackets 18. Nuts 28 are then threaded onto threaded bolts 26 and tightened until seam 16 is approximately one half (½) of an inch wide. As seen in FIGS. 5 and 6, additional nuts 30 are preferably placed between corresponding brackets 18 on threaded bolts 26 to allow seam 16 to be expanded if needed.

Figure 10:
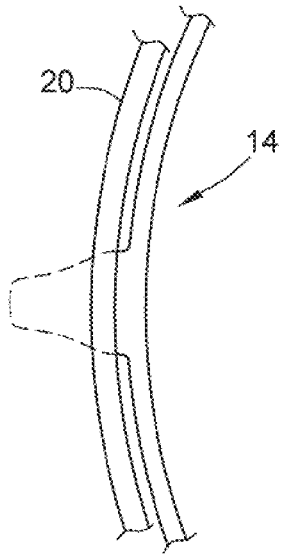
FIG. 10 is an exploded side elevational view of the outer sleeve used in the preferred embodiment of a compaction wheel for landfill compactors in accordance with the present invention shown in FIG. 1 used in conjunction with a used prior art compaction wheel for landfill compactors taken from circle 10—10 in FIG. 9.
Figure 9:
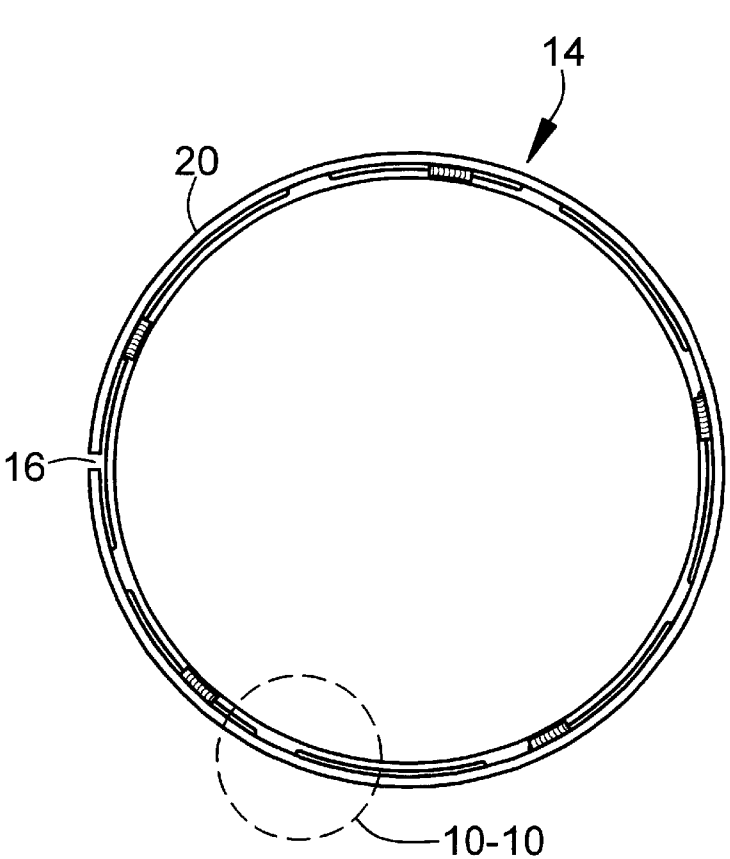
FIG. 9 is a side elevational view of the outer sleeve used in the preferred embodiment of a compaction wheel for landfill compactors in accordance with the present invention shown in FIG. 1 used in conjunction with a used prior art compaction wheel for landfill compactors.
Figure 8:
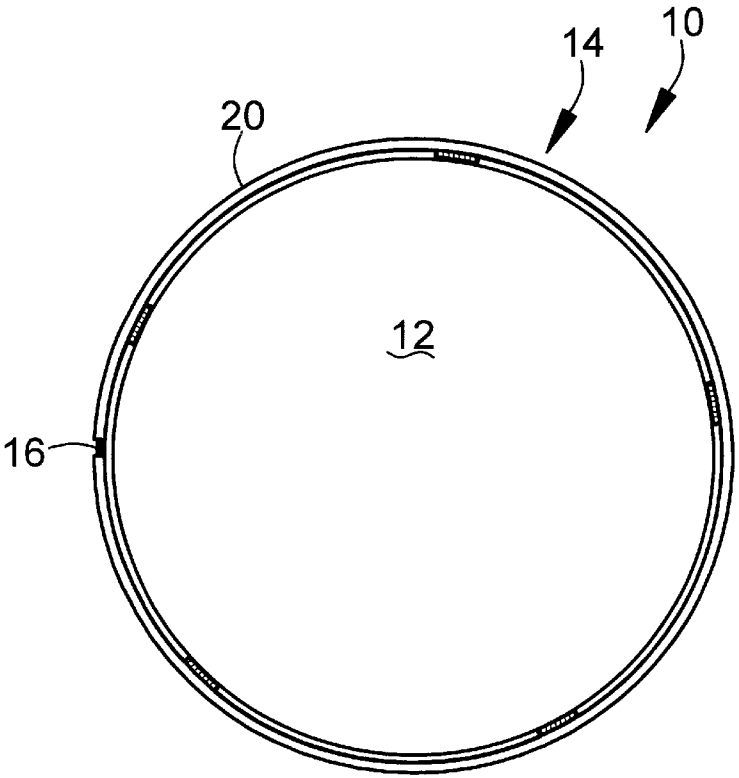
FIG. 8 is a side elevational view of the outer sleeve used in the preferred embodiment of a compaction wheel for landfill compactors in accordance with the present invention shown in FIG. 1 used in conjunction with a new wheel core.

Referring to FIGS. 8, 9 and 10, which show a side elevational view of the outer sleeve used in the preferred embodiment of a compaction wheel for landfill compactors in accordance with the present invention shown in FIG. 1 used in conjunction with a new wheel core, a side elevational view of the outer sleeve used in the preferred embodiment of a compaction wheel for landfill compactors in accordance with the present invention shown in FIG. 1 used in conjunction with a used prior art compaction wheel for landfill compactors and an exploded side elevational view of the outer sleeve used in the preferred embodiment of a compaction wheel for landfill compactors in accordance with the present invention shown in FIG. 1 used in conjunction with a used prior art compaction wheel for landfill compactors taken from circle 10—10 in FIG. 9, respectively, when seam 16 is approximately one half (½) of an inch wide, five (5) welds, each of which are approximately four (4) inches in length, are preferably substantially equidistantly spaced around the perimeter of wheel core 12 between wheel core 12 and outer sleeve 14 to secure outer sleeve 14 to wheel core 12. Once so positioned and secured, seam 16 is preferably filled with weld metal to provide a substantially continuous exterior surface 20 for outer sleeve 14 and brackets 18 are removed using, for example, a pair of pliers.

Figure 12:
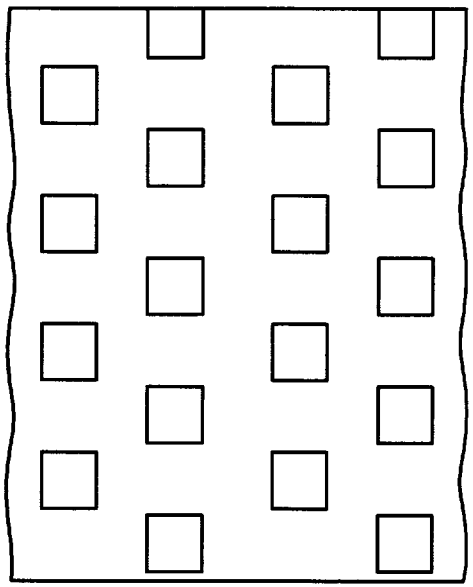
FIG. 12 is a front elevational view of a prior art repaired compaction wheel for landfill compactors.
Figure 11:
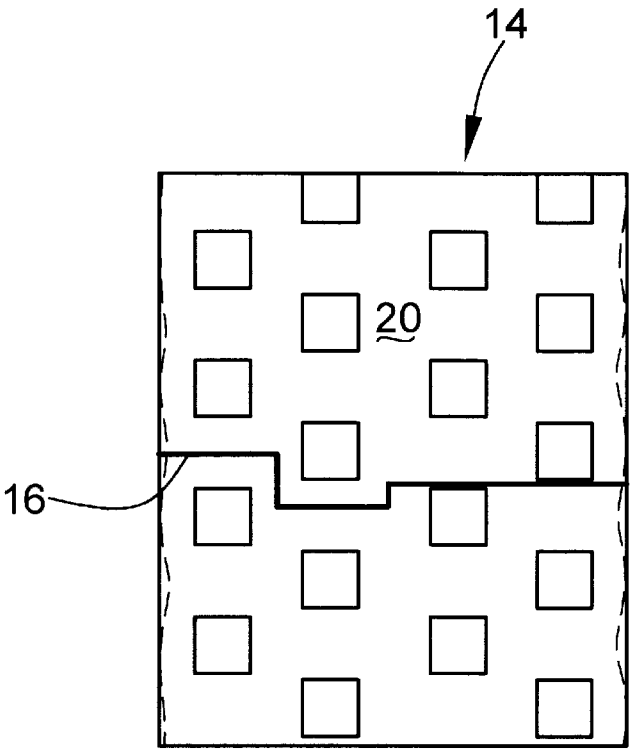
FIG. 11 is a front elevational view of the preferred embodiment of a compaction wheel for landfill compactors in accordance with the present invention shown in FIG. 1 with a new outer sleeve installed thereon.

Referring to FIGS. 11 and 12, which show a front elevational view of the preferred embodiment of a compaction wheel for landfill compactors in accordance with the present invention shown in FIG. 1 with a new outer sleeve installed thereon and a front elevational view of a prior art repaired compaction wheel for landfill compactors, respectively, outer sleeve 14 provides a straight outer edge for compaction wheel for landfill compactors 10 in accordance with the present invention in contrast to the wavy inner and outer edges present in many prior art repaired compaction wheels.

In the preferred embodiment of compaction wheel for landfill compactors 10 shown in FIGS. 1 through 12, the bolt pattern has an inside diameter of approximately twenty eight (28) inches and an outside diameter of approximately thirty four (34) inches, the inner ring of wheel core 12 is approximately thirty four (34) inches in diameter and approximately thirty (30) inches long, the two (2) sidewalls in wheel core 12 have an inside diameter of approximately thirty four (34) inches, an outside diameter of approximately fifty eight (58)

inches and are formed to a contour of approximately thirty seven (37) degrees, the outer ring of wheel core 12 is approximately fifty nine (59) inches in diameter and approximately forty seven and one half (47 ½) inches long, outer sleeve 14 is approximately sixty (60) inches in diameter and approximately forty eight and one half (48 ½) inches long and the cleats may be of different sizes and configurations. However, it will be readily recognized to those having a level of ordinary skill in the relevant art that the teachings of the present invention could be readily applied to compaction wheels for landfill compactors of other sizes and configurations.

Accordingly, although the present invention has been described above in detail, the same is by way of illustration and example only and is not to be taken as a limitation on the present invention. It is apparent to those having a level of ordinary skill in the relevant art that other variations and modifications in a compaction wheel for landfill compactors in accordance with the present invention, as described and shown herein, could be readily made using the teachings of the present invention. Accordingly, the scope and content of the present invention are to be defined only by the terms of the appended claims.

What is claimed is:

1. A compaction wheel for landfill compactors, comprising:

a wheel core having an outside diameter; and a one-piece outer sleeve having a first end, a second end opposite said first end, an inboard side, and an outboard side opposite said inboard side, wherein said outer sleeve is formed to be positioned over said outside diameter of said wheel core, said one-piece outer sleeve secured to said wheel core by a plurality of welds about an interface of said wheel core and said inboard side and said outboard side of said one-piece outer sleeve and said one-piece outer sleeve secured to said wheel core by a weld formed in a gap between said first end and said second end.

2. The compaction wheel for landfill compactors in accordance with claim 1, wherein said one-piece outer sleeve has a outside surface and said outside surface of said one-piece outer sleeve has a plurality of cleats preassembled thereon.

3. The compaction wheel for landfill compactors in accordance with claim 1, wherein said gap being approximately three (3) inches wide when said one-piece outer sleeve is in its free state and approximately one half (½) of an inch wide when said one-piece outer sleeve is tightened around said wheel core.

4. The compaction wheel for landfill in accordance with claim 3, wherein said one-piece outer sleeve includes a plurality of brackets positioned on said first end and said second end adjacent to said gap, each of said bracket of said plurality of brackets including an opening therein and a fastener is placed between said openings in corresponding said plurality of brackets to tighten said one-piece outer sleeve around said wheel core.

5. The compaction wheel for landfill compactors in accordance with claim 4, wherein said plurality of brackets are capable of being removed once said one-piece outer sleeve is welded to said wheel core.

6. The compaction wheel for landfill compactors of claim 1 in which said plurality of welds about said interface of said wheel core and said inboard side and said outboard side of said one-piece outer sleeve are substantially equidistantly spaced around the perimeter of said wheel core.

7. An outer sleeve for repairing a compaction wheel for landfill compactors including a wheel core having an outside diameter, said outer sleeve comprising a one-piece construction having a first end, a second end opposite said first end, an inboard side, and an outboard side opposite said inboard side, said one-piece outer sleeve formed to be positioned over said outside diameter of said wheel core and secured to said wheel core by a plurality of welds about an interface of said wheel core and said inboard side and said outboard side of said one-piece outer sleeve and said one-piece outer sleeve secured to said wheel core by a weld formed in a gap between said first end and said second end.

8. The outer sleeve for repairing a compaction wheel for landfill compactors in accordance with claim 7, wherein said one-piece outer sleeve has an outside surface and said outside surface of said one-piece outer sleeve has a plurality of cleats preassembled thereon.

9. The outer sleeve for repairing a compaction wheel for landfill compactors in accordance with claim 9, wherein said gap is approximately three (3) inches wide when said one-piece outer sleeve is in its free state and approximately one half (½) of an inch wide when said one-piece outer sleeve is tightened around said wheel core.

10. The outer sleeve for repairing a compaction wheel for landfill compactors in accordance with claim 7, wherein said one-piece outer sleeve includes a plurality of brackets positioned on said first end and said second end adjacent to said gap, each of said plurality of brackets including an opening therein and a fastener is placed between said openings in corresponding said plurality of brackets to tighten said one-piece outer sleeve around said wheel core.

11. The outer sleeve of claim 7 in which said plurality of welds about said interface of said wheel core and said inboard side and said outboard side of said one-piece outer sleeve are substantially equidistantly spaced around the perimeter of said wheel core.

12. A method of repairing a compaction wheel for landfill compactors including a wheel core having an outside diameter, comprising the steps of:

sliding a one-piece outer sleeve having a first end, a second end opposite said first end, an inboard side, and an outboard side opposite said inboard side, over the outside diameter of said wheel core, positioning said one-piece outer sleeve in the proper longitudinal relationship with said wheel core such that said inboard side and said outboard side extend beyond said wheel core in an overlapping manner;

tightening said one-piece outer sleeve around said outside diameter of said wheel core; and welding said inboard and outboard sides of said one-piece outer sleeve to said wheel core at a plurality of locations; and welding said first end and said second end of said one-piece outer sleeve to said wheel core.

13. The method of repairing a compaction wheel for landfill compactors in accordance with claim 12, wherein the step of tightening said one-piece outer sleeve around the outside diameter of the compaction wheel comprises inserting a plurality of fasteners through openings in a plurality of brackets on the exterior surface of said first end and said second end of said one-piece outer sleeve and tightening said plurality of fasteners to tighten said one-piece outer sleeve around the compaction wheel.

14. The method of repairing a compaction wheel for landfill compactors in accordance with claim 13, further including the step of removing said plurality of fasteners and said plurality of brackets from said first end and said second end of said one-piece outer sleeve following the step of welding said inboard and outboard sides of said one-piece outer sleeve to said wheel core at a plurality of locations.

15. The method of repairing a compaction wheel of claim 12 further comprising the initial step of removing a worn one-piece sleeve from a wheel core still attached to said landfill compactor.

16. The method of repairing a compaction wheel of claim 15 wherein said step of removing said worn one-piece sleeve from a wheel core is accomplished by breaking all welds between said wheel core and said worn one-piece sleeve.

17. A compaction wheel for landfill compactors, comprising:

a wheel core having an outside diameter; and a one-piece outer sleeve having a first end, a second end opposite said first end, an inboard side, and an outboard side opposite said inboard side, wherein said outer sleeve is formed to be positioned over said outside diameter of said wheel core, said one-piece outer sleeve removably secured to said wheel core, wherein said sleeve has a gap between said first end and said second end when said one-piece outer sleeve is removably secured to said wheel core.

18. An outer sleeve for repairing a compaction wheel for landfill compactors including a wheel core having an outside diameter, said outer sleeve comprising a one-piece construction having a first end, a second end opposite said first end, an inboard side, and an outboard side opposite said inboard side, said one-piece outer sleeve formed to be positioned over said outside diameter of said wheel core and removably secured to said wheel core, wherein said sleeve has a gap between said first end and said second end when said one-piece outer sleeve is removably secured to said wheel core.

19. A method of repairing a compaction wheel for landfill compactors including a wheel core having an outside diameter, comprising the steps of:

sliding a one-piece outer sleeve having a first end, a second end opposite said first end, an inboard side, and an outboard side opposite said inboard side, over the outside diameter of said wheel core;

positioning said one-piece outer sleeve in the proper longitudinal relationship with said wheel core such that said inboard side and said outboard side extend beyond said wheel core in an overlapping manner;

tightening said one-piece outer sleeve around said outside diameter of said wheel core; and removably securing said outer sleeve to said wheel core at a plurality of locations such that a gap exists between said first end and said second end of said outer sleeve.

* * * * *